US007444964B2

(12) United States Patent
Kanada et al.

(10) Patent No.: US 7,444,964 B2
(45) Date of Patent: Nov. 4, 2008

(54) VARIABLE VALVE TIMING CONTROL DEVICE

(75) Inventors: Yoji Kanada, Gamagori (JP); Osamu Komazawa, Chita (JP)

(73) Assignee: Aisin Seiki Kabushiki Kaisha, Aichi (JP)

( * ) Notice: Subject to any disclaimer, the term of this patent is extended or adjusted under 35 U.S.C. 154(b) by 161 days.

(21) Appl. No.: 11/629,899

(22) PCT Filed: Jul. 27, 2005

(86) PCT No.: PCT/JP2005/014162

§ 371 (c)(1),
(2), (4) Date: Dec. 18, 2006

(87) PCT Pub. No.: WO2006/011648

PCT Pub. Date: Feb. 2, 2006

(65) Prior Publication Data

US 2008/0022953 A1 Jan. 31, 2008

(30) Foreign Application Priority Data

Jul. 28, 2004 (JP) ..... 2004-220894

(51) Int. Cl.
*F01L 1/34* (2006.01)

(52) U.S. Cl. ..... 123/90.15; 123/90.17; 464/160

(58) Field of Classification Search ..... 123/90.15, 123/90.16, 90.17, 90.18; 464/1, 2, 160
See application file for complete search history.

(56) References Cited

U.S. PATENT DOCUMENTS

| | | | |
|---|---|---|---|
| 5,289,805 A | 3/1994 | Quinn, Jr. et al. | |
| 6,684,835 B2 | 2/2004 | Komazawa et al. | |
| 6,779,500 B2 | 8/2004 | Kanada et al. | |
| 6,820,578 B2 * | 11/2004 | Kanada et al. | 123/90.15 |
| 6,976,460 B2 * | 12/2005 | Komazawa et al. | 123/90.15 |

FOREIGN PATENT DOCUMENTS

| | | |
|---|---|---|
| DE | 101 04 038 A1 | 1/2001 |
| EP | 1 087 106 A2 | 9/2000 |
| EP | 1 312 773 A2 | 10/2002 |
| JP | 2003-013714 | 6/2001 |
| JP | 2003-172109 | 12/2001 |

OTHER PUBLICATIONS

International Search Report mailed Nov. 11, 2005.

* cited by examiner

*Primary Examiner*—Ching Chang
(74) *Attorney, Agent, or Firm*—Reed Smith LLP; Stanley P. Fisher, Esq.; Juan Carlos A. Marquez, Esq.

(57) ABSTRACT

A variable valve timing control device includes a driving side rotational member (2) synchronously rotating with a crankshaft, a driven side rotational member (1) positioned coaxially with the driving side rotational member, and synchronously rotating with a camshaft, a fluid pressure chamber (40), formed in at least one of the driving side rotational member and the driven side rotational member, for generating a biasing force for changing a relative rotational phase between the driving side rotational member and the driven side rotational member by hydraulic fluid supplied into or discharged from the fluid pressure chamber, a lock mechanism (6) movable between a lock position for preventing a relative rotation between the driving side rotational member and the driven side rotational member and a lock release position for allowing the relative rotation, a lock release pressure chamber (62) for generating a biasing force to move the lock mechanism (6) to the lock release position by supply of the hydraulic fluid, a phase control device (71) for controlling a rate of the relative rotational phase change by controlling supply or discharge of hydraulic fluid into or out of the fluid pressure chamber, and a lock control device (72) for controlling supply or discharge of hydraulic fluid into or out of the lock release pressure chamber, wherein the phase control device restricts an upper limit of the rate of the relative rotational phase change when the lock control device supplies hydraulic fluid to the lock release pressure chamber.

7 Claims, 6 Drawing Sheets

VARIABLE VALVE TIMING CONTROL DEVICE

TECHNICAL FIELD

The present invention is directed to a variable valve timing control device and more particularly to such device for controlling adjustment of valve timing of an internal combustion engine for, for example, an automobile.

BACKGROUND ART

A known variable valve timing control device for achieving a favorable driving condition by appropriately adjusting a valve timing of an internal combustion engine such as an automobile engine is described, for example, in JP2003-13714A (pp. 2-6, FIGS. 1-2) corresponding to U.S. Pat. No. 6,779,500 (Columns 2-10, FIGS. 1-2). The known variable valve timing control device includes a housing rotating in unison with a crankshaft, a rotor rotating in unison with a camshaft, a fluid pressure chamber provided between the housing and the rotor, a vane for defining the fluid pressure chamber into an advanced angle chamber and a retarded angle chamber, a lock mechanism including a lock plate configured to be projected from the housing into a lock groove formed on the rotor by means of supply of hydraulic oil for restricting relative rotation between the housing and the rotor at an intermediate phase between a most advanced phase angle and a most retarded phase angle, and an oil pressure control valve for controlling supply or discharge of hydraulic oil to the advanced angle chamber, the retarded angle chamber, and the lock mechanism. A passage for supplying or discharging hydraulic oil to or from the lock mechanism is formed independently from a passage for supplying and discharging hydraulic oil to and from the advanced angle chamber and the regarded angle chamber. Hydraulic oil is supplied to the oil pressure control valve from an oil pump driven by the internal combustion engine.

The variable valve timing control device moves a relative position of the vane in the fluid pressure chamber by supplying hydraulic oil to one of the advanced angle chamber and the retarded angle chamber and discharging hydraulic oil from the other of the advanced angle chamber and the retarded angle chamber to adjust relative rotational phase between the housing and the rotor. When the internal combustion engine starts up, for example relative rotational phase between the housing and the rotor is fixed by the lock mechanism, and after a warm-up period, the lock can be released by retracting the lock plate from the lock groove by supplying hydraulic oil to the lock mechanism. In this case, influence of pressure fluctuation is not likely to be transmitted to the passage for supplying or discharging hydraulic oil to the lock mechanism even if pressure of hydraulic oil in the fluid pressure chamber is fluctuated because of fluctuating torque from the camshaft when changing the relative rotational phase between the housing and the rotor by forming the passage for supplying or discharging hydraulic oil to the lock mechanism independently from the passage for supplying or discharging hydraulic oil to the advanced angle chamber and the retarded angle chamber. Thus, according to the known variable valve timing control device described in JP2003-13714A, when displacing relative rotational phase between the housing and the rotor, the device helps prevent that the pressure of hydraulic oil supplied to the lock mechanism is temporarily reduced by the pressure fluctuation due to a fluctuating torque from the camshaft and the lock plate is engaged in the lock groove at the intermediate phase.

However, with the known construction of variable valve timing control device described in JP2003-13714A, because a common oil pump is used for supplying hydraulic oil to the advanced angle chamber and the retarded angle chamber and for supplying hydraulic oil to the lock mechanism, pressure of hydraulic oil supplied to the lock mechanism descreases temporarily because a large amount of hydraulic oil needs to be supplied to the advanced angle chamber or the retarded angle chamber when the change in the relative rotational phase between the housing and the rotor needs to be large. Therefore, the lock plate may improperly engage with the lock groove at the intermediate phase, or the lock plate may be temporarily caught at the lock groove even if it is not fully engaged A need thus exists for a variable valve timing control device which prevents a lock mechanism from being caught in the lock groove upon a change of a relative rotational phase between a driving side rotational member and a driven side rotational member.

DISCLOSURE OF THE INVENTION

In light of the foregoing, the present invention provides a variable valve timing control device, which includes a driving side rotational member synchronously rotating with a crankshaft, a driven side rotational member positioned coaxially with the driving side rotational member, and synchronously rotating with a camshaft, a fluid pressure chamber, formed in at least one of the driving side rotational member and the driven side rotational member, for generating a biasing force for changing a relative rotational phase between the driving side rotational member and the driven side rotational member by hydraulic fluid supplied into or discharged from the fluid pressure chamber, a lock mechanism movable between a lock position for preventing a relative rotation between the driving side rotational member and the driven side rotational member and a lock release position for allowing the relative rotation, a lock release pressure chamber for generating a biasing force to move the lock mechanism to the lock release position by supply of the hydraulic fluid, a phase control device for controlling a rate of the relative rotational phase change by controlling supply or discharge of hydraulic fluid into or out of the fluid pressure chamber, and a lock control device (72) for controlling supply or discharge of hydraulic fluid into or out of the lock release pressure chamber. The phase control device restricts an upper limit of the rate of the relative rotational phase change when the lock control device supplies hydraulic fluid to the lock release pressure chamber.

BRIEF DESCRIPTION OF THE DRAWINGS

The foregoing and additional features and characteristics of the present invention will become more apparent from the following detailed description considered with reference to the accompanying drawing figures in which like reference numerals designate like elements.

MODE FOR CARRYING OUT THE INVENTION

One embodiment of the present invention will be explained next with reference to the drawings. The embodiment of a variable valve timing control device for an automobile engine will be explained referring to FIGS. 1-7.

Figure 1:
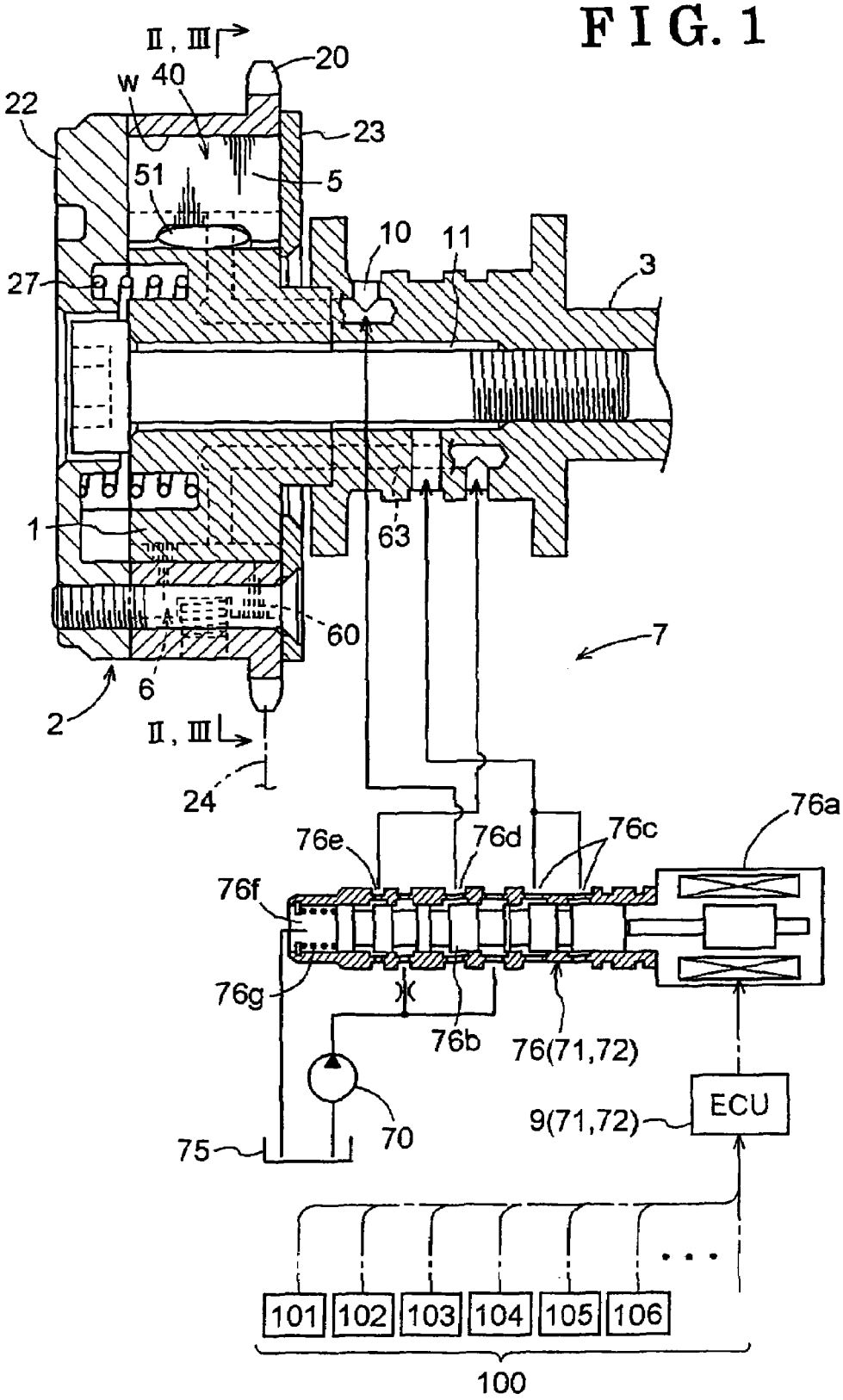
FIG. 1 is a lateral cross-sectional view showing a construction of a variable valve timing control device according to an embodiment of the present invention.

First, basic construction of the variable valve timing control device will be explained with reference to FIGS. 1-3. The variable valve timing control device includes an external rotor 2 serving as a driving side rotational member for rotating synchronously with a crankshaft of an engine, and an internal rotor 1 serving as a driven side rotational member for synchronously rotating with a camshaft 3.

The internal rotor 1 is mounted integrally to an end portion of the camshaft 3 serving as a rotational shaft of a cam for controlling opening and closing of an intake valve or an exhaust valve of an engine. The camshaft 3 is rotatably mounted to a cylinder head of the engine.

The internal rotor 1 is fit inside of the external rotor 2 such that the external rotor 2 can be rotated with respect to the internal rotor 1 within a range of a predetermined relative rotational phase. A front plate 22 is integrally mounted to the external rotor 2 at an opposite side where the camshaft 3 is connected, and a rear plate 23 is integrally attached to the external rotor 2 at a side where the camshaft 3 is connected. A timing sprocket 20 is integrally provided at an external periphery of the external rotor 2. A power transmission member 24 such as a timing chain and a timing belt is provided between the timing sprocket 20 and the crankshaft of the engine.

Figure 2:
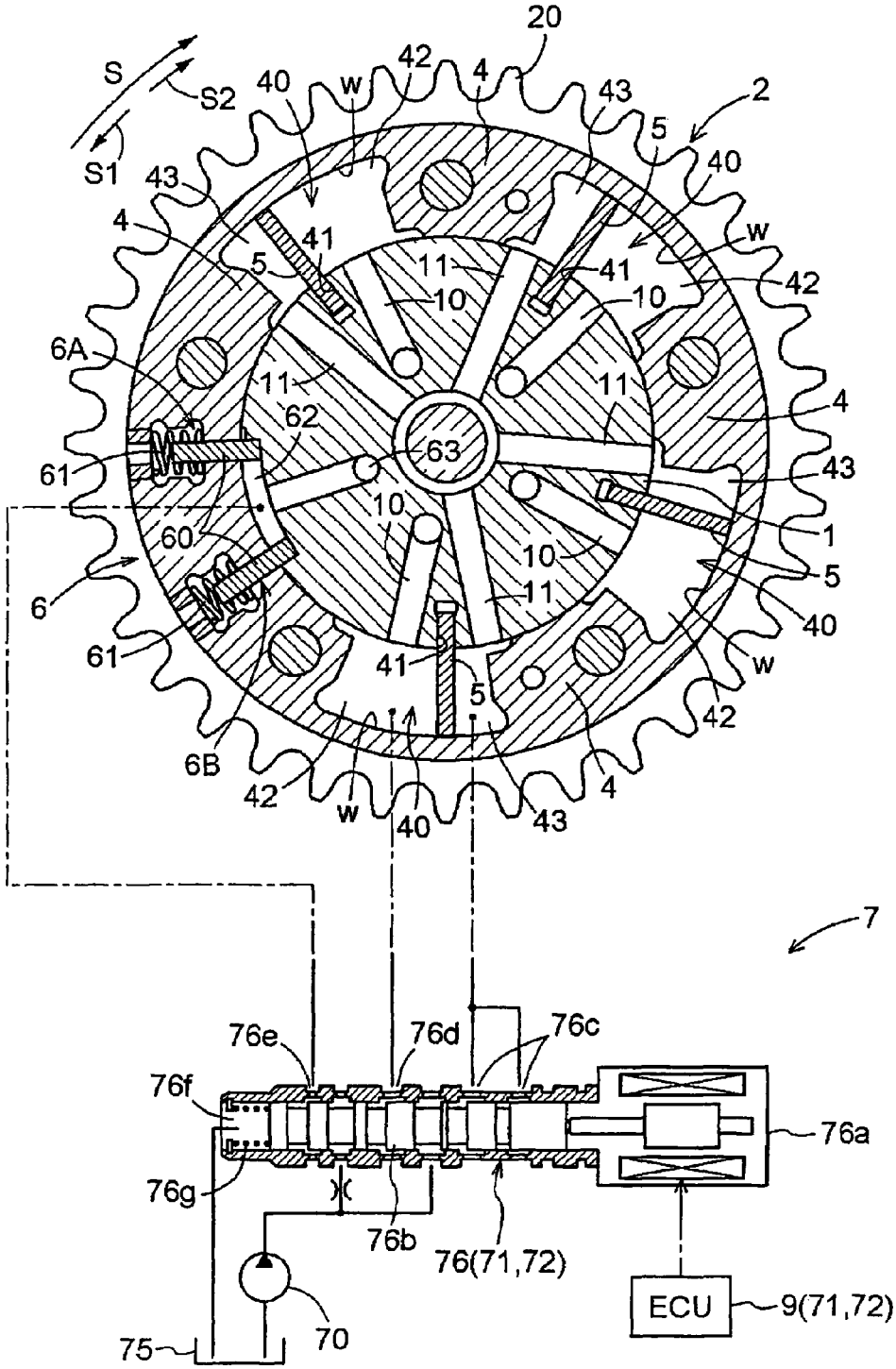
FIG. 2 is a cross-sectional view taken on line II-II showing a locked state of a relative rotational phase by a lock mechanism.

Upon rotation of the engine crankshaft, rotational force is transmitted to the timing sprocket 20 via the power transmission member 24, the external rotor 2 rotates along a rotational direction S shown in FIG. 2, the internal rotor 1 rotates in the rotational direction S to rotate the camshaft 3, and a cam provided at the camshaft 3 pushes the intake valve or the exhaust valve down to open the valve.

As shown in FIG. 2, plural projection portions 4 each serving as a shoe projected in a radial direction are arranged on the external rotor 2 having intervals from each other along the rotational direction. A fluid pressure chamber 40 defined by the external rotor 2 and the internal rotor 1 is formed between adjacent projection portions 4 of the external rotor 2. For example, four fluid pressure chambers 40 are formed according to the embodiment of the present invention.

A vane groove 41 is formed on an external periphery portion of the internal rotor 1 facing each fluid pressure chamber 40. A vane 5 for defining the fluid pressure chamber 40 into an advanced angle chamber 43 and a retarded angle chamber 42 in a relative rotational direction (i.e., in the direction of arrows S1, S2 of FIG. 2) is slidably located in the vane groove 41 along radial direction. The vane 5 is biased towards an internal wall surface w of the fluid pressure chamber 40 by means of a spring 51 provided at an inner radial side of the vane 5.

The advanced angle chamber 43 of the fluid pressure chamber 40 is in communication with an advanced angle passage 11 formed on the internal rotor 1, the retarded angle chamber 42 is in communication with a retarded angle passage 10 formed on the internal rotor 1, and the advanced angle passage 11 and the retarded angle passage 10 are connected to an hydraulic circuit 7. Biasing force for changing or maintaining a relative rotational phase between the internal rotor 1 and the external rotor 2 is generated by supplying or discharging hydraulic oil from or to the hydraulic circuit 7 relative to one of or both of the advanced angle chamber 43 and the retarded angle chamber 42.

A torsion coil spring 27 for constantly biasing the vane 5 in an advanced angle direction is provided between the internal rotor 1 and the front plate 2. A lock mechanism 6 is provided between the internal rotor 1 and the external rotor 2 for locking relative rotation between the internal rotor 1 and the external rotor 2 when relative rotational phase is at a predetermined locked phase (i.e., a phase shown in FIG. 2) defined between a most advanced angle phase and a most retarded angle phase. The lock mechanism 6 includes a lock portion 6A for retarded angle provided at the external rotor 2, a lock portion 6B for advanced angle provided at the external rotor 2, and a recessed lock chamber 62 provided at a portion of an external peripheral portion of the internal rotor 1. The lock chamber 62 is in communication with a lock passage 63 formed on the internal rotor 1, and the lock passage 63 is connected to the hydraulic circuit 7.

Each of the lock portion 6A for retarded angle and the lock portion 6B for advanced angle includes a lock body 60 slidably provided at the external rotor 2 in a radial direction and a spring 61 for biasing the lock body 60 towards a radially internal direction. The lock body 60 may be shaped in plate configuration, pin configuration, and other configurations.

The lock portion 6A for retarded angle prevents the relative rotation of the internal rotor 1 in the retarded angle direction relative to the external rotor 2 by projecting the lock body 60 into the lock chamber 62. The lock portion 6B for advanced angle prevents the relative rotation of the internal rotor 1 in the advanced angle direction relative to the external rotor 2 by projecting the lock body 60 into the lock chamber 62. In this case, the lock body 60 is projected into the lock chamber 62 at a drain state where hydraulic oil is not supplied to the lock chamber 62 by means of the biasing force of the spring 61. As shown in FIG. 2, with the lock mechanism 6, a lock position for preventing a relative rotational phase between the internal rotor 1 and the external rotor 2 at a predetermined locked phase defined between the most advanced phase angle and the most retarded phase angle at a state where the both lock bodies 60, 60 for the lock portion 6A for the retarded angle and for the lock portion 6B for the advanced angle are projected into the lock chamber 62. The locked phase is set to be a phase with which the valve timing of the engine is smoothly started.

On the other hand, the lock body 60 is retracted from the lock chamber 62 by supplying hydraulic oil from the hydraulic circuit 7 to the lock chamber 62 via the lock passage 63. That is, when the lock chamber 62 is supplied and filled with hydraulic oil, and when the biasing force affecting the lock body 60 in a direction for accommodating the lock body 60 into the external rotor 2 by the pressure of hydraulic oil (i.e., in the direction for retracting the lock body 60 from the lock chamber 62) assumes greater than the biasing force of the spring 61 for biasing the lock body 60 in a direction to be projected into the lock chamber 62, the lock body 60 is retracted from the lock chamber 62, as shown in FIG. 3. Thus, lock release condition (or a lock release position) for allowing relative rotation between the internal rotor 1 and the external rotor 2 is achieved. According to the embodiment of the present invention, the lock chamber 62 serves as a lock release pressure chamber.

The hydraulic circuit 7 includes a control valve 76 controlled by a control unit (ECU: Electric Control Unit) 9 for controlling supply amount or discharge amount of hydraulic oil at plural ports, an oil pump 70 actuated by driving force of the engine for supplying hydraulic oil to the control valve 76, and a oil pan 75 for reserving hydraulic oil. According to the embodiment of the present invention, a variable electromagnetic spool valve for displacing a spool 76*b* against a spring 76*g* by energization from the control unit 9 to a solenoid 76*a* is used as the control valve 76. The advanced angle passage 11 in communication with the advanced angle chamber 43 is connected to a first port 76*c* of the control valve 76, the retarded angle passage 10 in communication with the retarded angle chamber 42 is connected to a second port 76*d*, and the lock passage 63 in communication with the lock chamber 62 is connected to a third port 76*e*. A drain port 76*f* of the control valve 76 is in communication with the oil pan 75.

The control valve 76 controlled by the control unit 9 supplies or discharges hydraulic oil relative to the advanced angle chamber 43 and the retarded angle chamber 42 via the advanced angle passage 11 and the retarded angle passage 10 respectively, changes relative position of the vane 5 in the fluid pressure chamber 40, and changes the relative rotational phase between the external rotor 2 and the internal rotor 1 between the most advanced phase angle (i.e., relative rotational phase when the volume of the advanced angle chamber 43 is maximized) and the most retarded phase angle (i.e., relative rotational phase when the volume of the retarded angle chamber 42 is maximized). In this case, the control valve 76 is controlled by the control unit 9 to control the rate of relative rotational phase change between the internal rotor 1 and the external rotor 2 by controlling the amount of hydraulic oil supplied to the advanced angle chamber 43 and the retarded angle chamber 42 or discharged from the advanced angle chamber 43 and the retarded angle chamber 42. Thus, the control valve 76 and the control unit 9 serve as a phase control device 71, the control valve 76 serves as a fluid control mechanism of the phase control device 71, and the control unit 9 serves as a control means.

The control valve 76 also controls condition control operation between the lock position and lock release position of the lock mechanism 6. That is, the control valve 76 is controlled by the control unit 9 to control projecting and retracting the lock body 60 relative to the lock chamber 62 by controlling supply or discharge of hydraulic oil relative to the lock chamber 62 via the lock passage 63. Accordingly, the control valve 76 and the control unit 9 for controlling the control valve 76 serve as the lock control device 72.

Figure 4:
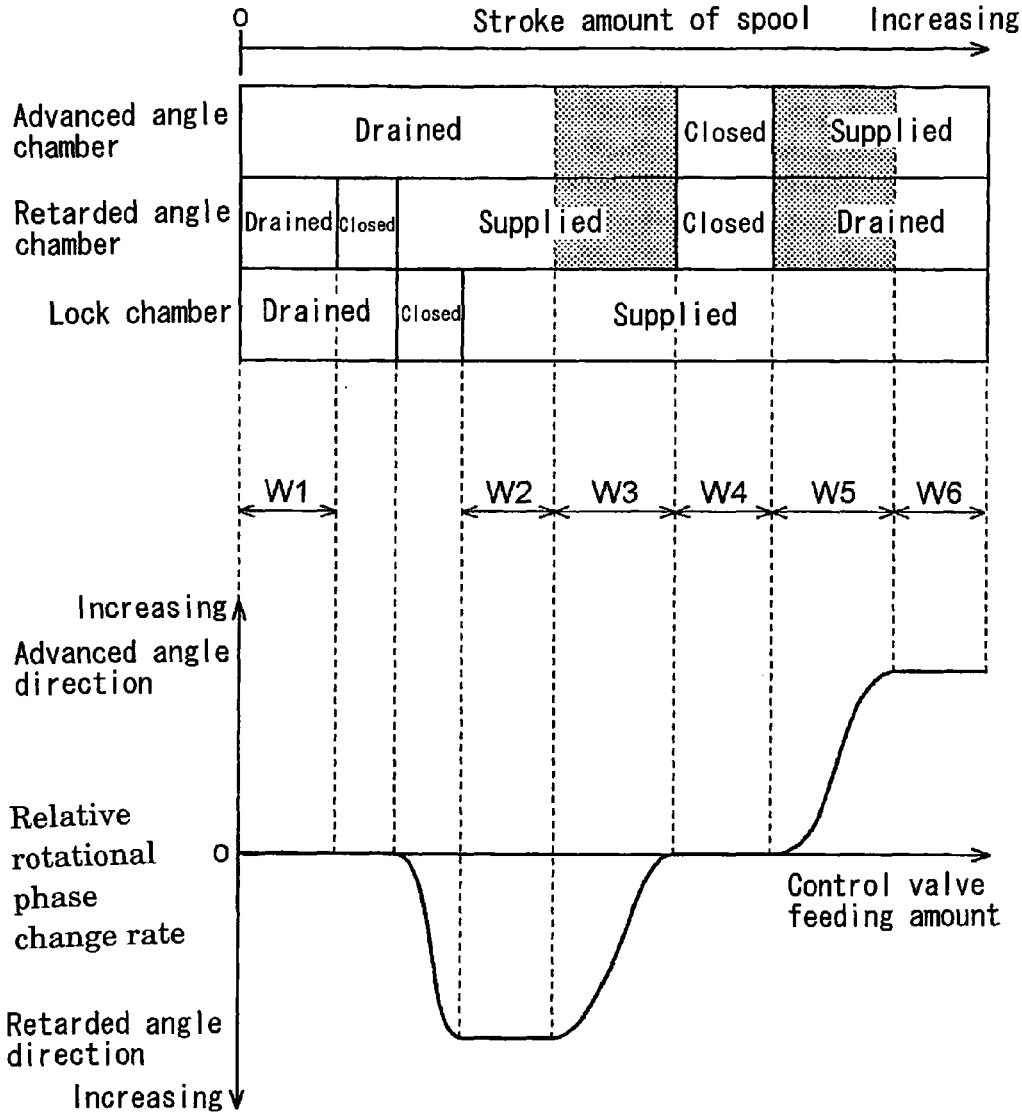
FIG. 4 is a view showing relationship between stroke amount of a spool of a control valve and an operational state, and a response characteristics table for displacement speed of the relative rotational phase according to the embodiment of the present invention.

As shown in FIG. 4, the control valve 76 of the hydraulic circuit 7 is configured to control stroke amount of the spool 76*b* by controlling feeding amount from the control unit 9 to the solenoid 76*a*, to vary spool position from position W1 through position W6, and to switch modes of supplying hydraulic oil, discharging (drain) hydraulic oil, and stopping (close) hydraulic oil to the advanced angle chamber 43, the retarded angle chamber 42, and the lock chamber 62. According to the embodiment of the present invention, feeding amount to the solenoid 76*a* is controlled by changing duty value (%) of the electric current supplied to the solenoid 76*a*. Stroke amount of the spool 76*b* is proportional to feeding amount to the solenoid 76*a* (i.e., duty value of the electric current). The feeding amount serves as a control variable of the present embodiment.

Operation of the control valve 76 at each spool position will be explained as follows. This is an example of the control operation with control valve 76, and may be varied.

The control valve 76 carries out drain operation for discharging (draining) hydraulic oil in the advanced angle chamber 43, the retarded angle chamber 42, and the lock chamber 62 to the oil pan 75 when the spool position is at position W1.

When the spool position is at position W2 or position W3, the control valve 76 establishes lock release position of the lock mechanism 6 for allowing relative rotation between the external rotor 2 and the internal rotor 1 by supplying hydraulic oil to the lock chamber 62. Further, displacement operation in the retarded angle direction is carried out for changing relative rotational phase between the external rotor 2 and the internal rotor 1 in the retarded angle direction S1 by supplying hydraulic oil to the retarded angle chamber 42 while draining hydraulic oil in the advanced angle chamber 43 when the spool position is within the range of position W2. The control valve 76 is configured to control one or both of the amount of hydraulic oil supplied to the retarded angle chamber 42 and the amount of hydraulic oil discharged from the advanced angle chamber 43 by varying opening amount of either or both of the first port 76*c* and the second port 76*d* as a function of (e.g. in proportion to) the stroke amount of the spool 76*b* when the spool position is within position W3. The rate of relative rotational phase change between the external rotor 2 and the internal rotor 1 is approximately proportional to fluid amount of hydraulic oil supplied to the retarded angle chamber 42 and discharged from the advanced angle chamber 43 accordingly. Thus, as shown in FIG. 4, the rate of relative rotational phase change between the external rotor 2 and the internal rotor 1 is changed in accordance with a predetermined response characteristics in accordance with feeding amount to the control valve 76 when the spool position is within the range of position W3.

The control valve 76 carries out a phase maintaining operation for maintaining a relative rotational phase between the external rotor 2 and the internal rotor 1 at that timing by stopping supply or discharge of hydraulic oil relative to the advanced angle chamber 43 and the retarded angle chamber 42 (i.e., the first port 76*c* and the second port 76*d* closed) where the lock mechanism 6 is maintained in the lock release position for allowing relative rotation between the external rotor 2 and the internal rotor 1 by supplying hydraulic oil in the lock chamber 62 when the spool position assumes at position W4.

The control valve 76 establishes lock release position of the lock mechanism 6 for allowing relative rotation between the external rotor 2 and the internal rotor 1 by supplying hydraulic oil in the lock chamber 62 when the spool position is at position W5 and position W6. Further, changing operation in the advanced angle direction for changing relative rotational phase between the external rotor 2 and the internal rotor 1 in the advanced angle direction S2 is carried out by supplying hydraulic oil in the advanced angle chamber 43 while draining hydraulic oil in the retarded angle chamber 42. In this case the control valve 76 is configured to control one or both of the amount of hydraulic oil supplied to the advanced angle chamber 43 and the amount of hydraulic fluid discharged from the retarded angle chamber 42 by varying the opening amount of one or both of the first port 76*c* and the second port 76*d* as a function of (e.g. in proportion to) the stroke amount of the spool 76*b* when the spool position is within the range of position W5. The rate of relative rotational phase change between the external rotor 2 and the internal rotor 1 is approximately proportional to fluid amount of hydraulic oil supplied to the advanced angle chamber 43 and fluid amount of hydraulic oil discharged from the retarded angle chamber 42 accordingly. Thus, as shown in FIG. 4, the rate of relative rotational phase change between the external rotor 2 and the internal rotor 1 is varied depending on a predetermined response characteristics in accordance with feeding amount to the control valve 76 also within the range of the spool position at position W5.

As shown in FIG. 4, the response characteristics of relative rotational phase change rate in accordance with feeding amount to the control valve 76 is stored in a memory 92 (i.e., serving as a change rate setting means and a memory means) of the control unit 9 as a response characteristics table. A CPU 91 (i.e., serving as a change rate setting means) of the control unit 9 controls the rate of relative rotational phase change between the external rotor 2 and the internal rotor 1 by determining feeding amount (i.e., duty value of electric current) for obtaining a predetermined rate of change in the relative rotational phase on the basis of the response characteristics table and by inputting the feeding amount to the control valve 76.

Figure 5:
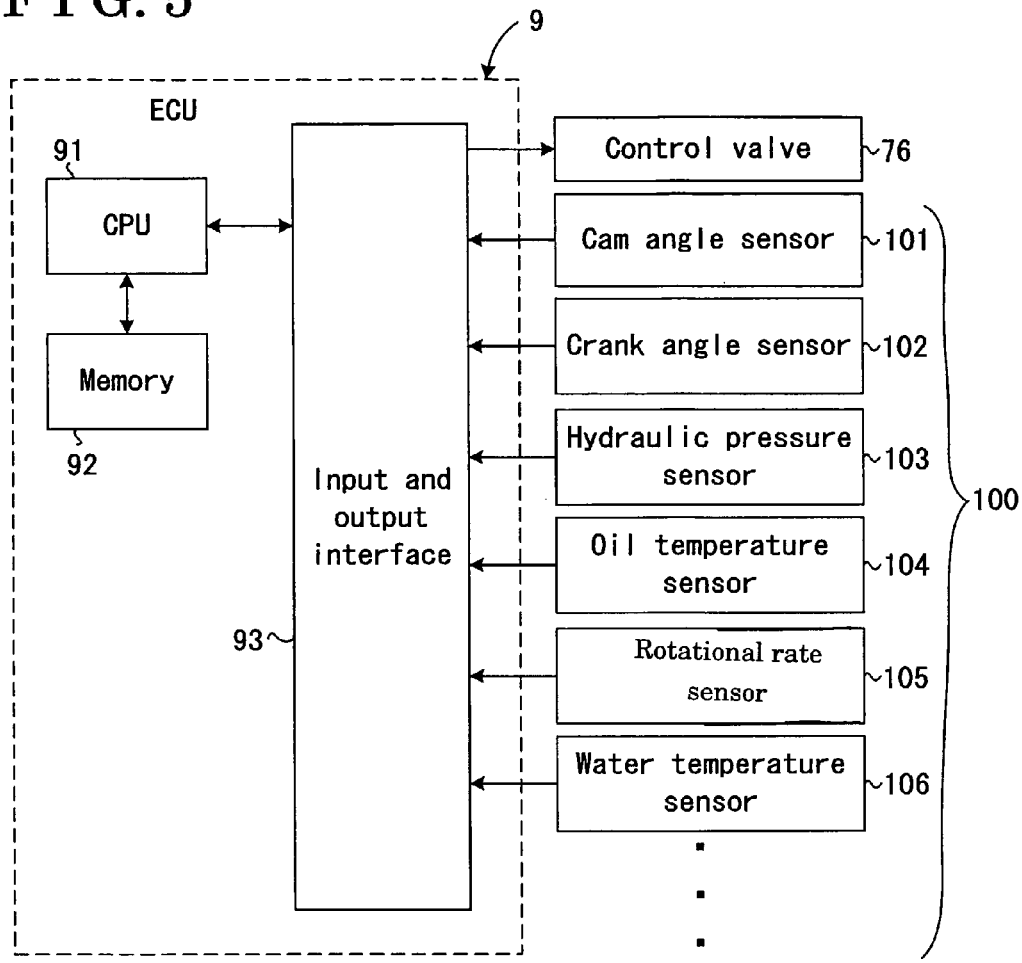
FIG. 5 is a block view showing an electric connection of a control unit, an operational state detection means and a control valve according to the embodiment of the present invention.

Construction of the control unit 9 and an operational state detection means 100 will be explained as follows. As shown in FIG. 5, the control unit 9 includes the CPU 91 for conducting calculation transaction, the memory 92 storing a predetermined program and a table, or the like, and an input and output interface 93. Detection signals from a cam angle sensor 101 (i.e., serving as a phase detection means) for detecting a phase of a camshaft, a crank angle sensor 102 (i.e., serving as a phase detection means) for detecting a phase of the crankshaft, a hydraulic pressure sensor 103 (i.e., serving as an hydraulic fluid pressure detection means) for detecting pressure of hydraulic oil, an oil temperature sensor 104 (i.e., serving as an hydraulic fluid temperature detection means) for detecting temperature of hydraulic oil, a rotational speed sensor 105 (i.e., serving as a rotational speed detection means) for detecting rotational speed (i.e., engine rotation rpm) of the crankshaft, and a water temperature sensor 106 (i.e., serving as a cooling water temperature detection means) for detecting cooling water temperature of the engine are inputted to the control unit 9. These sensors may be of known and conventional construction. For example, the phase detection means may have a magnetic sensor that senses cyclic magnetic field from a small piece of magnet placed on a shaft. The phase detection means does not have to have a magnet placed on a shaft. In stead, it may sense any physical changes such as changes in electromagnetic field or sound due to a rotation of the target object. The sensor means including the phase detection means can be of an active type where a proving pulse such as a sound pulse or electromagnetic (including laser, infrared, ultraviolet, visible light) pulse is sent toward the target object and the signal that is bounced by the object is analyzed. Detection signal from other sensors such as an IG key switch, a vehicle speed sensor, and a throttle opening sensor, or the like, inputted to the control unit 9. Pressure of hydraulic oil is detected by the hydraulic pressure sensor 103 at inlet side of the control valve 76 of the hydraulic pressure circuit 7. The rotational speed sensor 105 is not limited to a sensor which directly detects rotational speed of the crankshaft, and may be, for example, a sensor for detecting rotational speed of each portion of the engine driven by the crankshaft, such as the camshaft, the internal rotor 1 and the external rotor 2. The control unit 9 detects operational state of the engine on the basis of detection signal from various sensors. Thus, the various sensors serve as the operational state detection means 100.

The control unit 9 can calculate a relative rotational phase between the camshaft 3 and the crankshaft, that is, current phase of a relative rotational phase between the internal rotor 1 and the external rotor 2 of the variable valve timing control device on the basis of a phase of the camshaft 3 detected by the cam angle sensor 101 and a phase of the crankshaft detected by the crank angle sensor 102.

The control unit 9 controls feeding amount to the control valve 76 on the basis of operational state of the engine such as temperature of engine oil, rotational speed of the crankshaft, vehicle speed, and throttle opening degree detected by the various sensors serving as the operational sate detection means 100. The control unit 9 is configured to control supply amount or discharge amount of hydraulic oil relative to the advanced angle chamber 43 and the retarded angle chamber 42 by the control valve 76 so that a relative rotational phase between the internal rotor 1 and the external rotor 2 assumes a phase suitable for an operational state of the engine at the timing. When changing the relative rotational phase, the control unit 9 controls to restrict upper limit of the rate of relative rotational phase change between the internal rotor 1 and the external rotor 2 on the basis of operational state of the engine detected by the various sensors serving as the operational state detection means 100 in order to prevent the lock mechanism 6 from being caught.

Operation for controlling a relative rotational phase between the internal rotor 1 and the external rotor 2 of the variable valve timing control device will be explained as follows. The variable valve timing control device maintains a state where a relative rotational phase between the internal rotor 1 and the external rotor 2 is locked at a predetermined locked phase by maintaining the lock mechanism 6 in the lock position at a start of the engine and after start of the engine until warm-up is completed. After the warm-up of the engine is completed, the lock mechanism 6 is moved to the lock release position, and control of relative rotational phase is started.

After starting of control for a relative rotational phase between the internal rotor 1 and the external rotor 2, the control unit 9 controls the spool position of the control valve 76 to be displaced between position W2 and position W6 shown in FIG. 4 so that a relative rotational phase assumes an optimum phase in accordance with an operational state of the engine. The optimum relative rotational phase in accordance with an operational state of the engine is determined on the basis of information detected by means of the operational state detection means 100, and a phase determining table stored in the memory 92. The phase determining table is predetermined on the basis of an operational state of the engine such as temperature of engine oil, rotational speed of the crankshaft, vehicle speed, and throttle opening degree detected by the various sensors serving as the operational state detection means 100 and a phase of the camshaft 3 for the crankshaft which is the most suitable for the operational state, and the phase determining table is stored in the memory 92 as a table.

When relative rotational phase between the internal rotor 1 and the external rotor 2 is changed towards retarded angle, the control unit 9 displaces a spool position of the control valve 76 to either position W2 or position W3. Accordingly, hydraulic oil is supplied to the retarded angle chamber 42, hydraulic oil in the advanced angle chamber 43 is drained, and a relative rotational phase is changed in the advance angle direction S2 (shown in FIG. 3). On the other hand, when displacing a relative rotational phase to the advanced angle side, the controls unit 9 moves a spool position of the control valve 76 to either position W5 or position W6. Thus, hydraulic oil is supplied to the advanced angle chamber 43, hydraulic oil in the retarded angle chamber 42 is drained, and a relative rotational phase is changed in an advanced angle direction S2 (shown in FIG. 3). Thereafter, when a relative rotational phase between the internal rotor 1 and the external rotor 2 becomes the optimum phase in accordance with an operational state of the engine, a spool position of the control valve 76 is displaced to position W4. Thus, supply and discharge of hydraulic oil relative to the retarded angle chamber 42 and the advanced angle chamber 43 are stopped, and a relative rotational phase is maintained at the phase of that timing.

Figure 3:
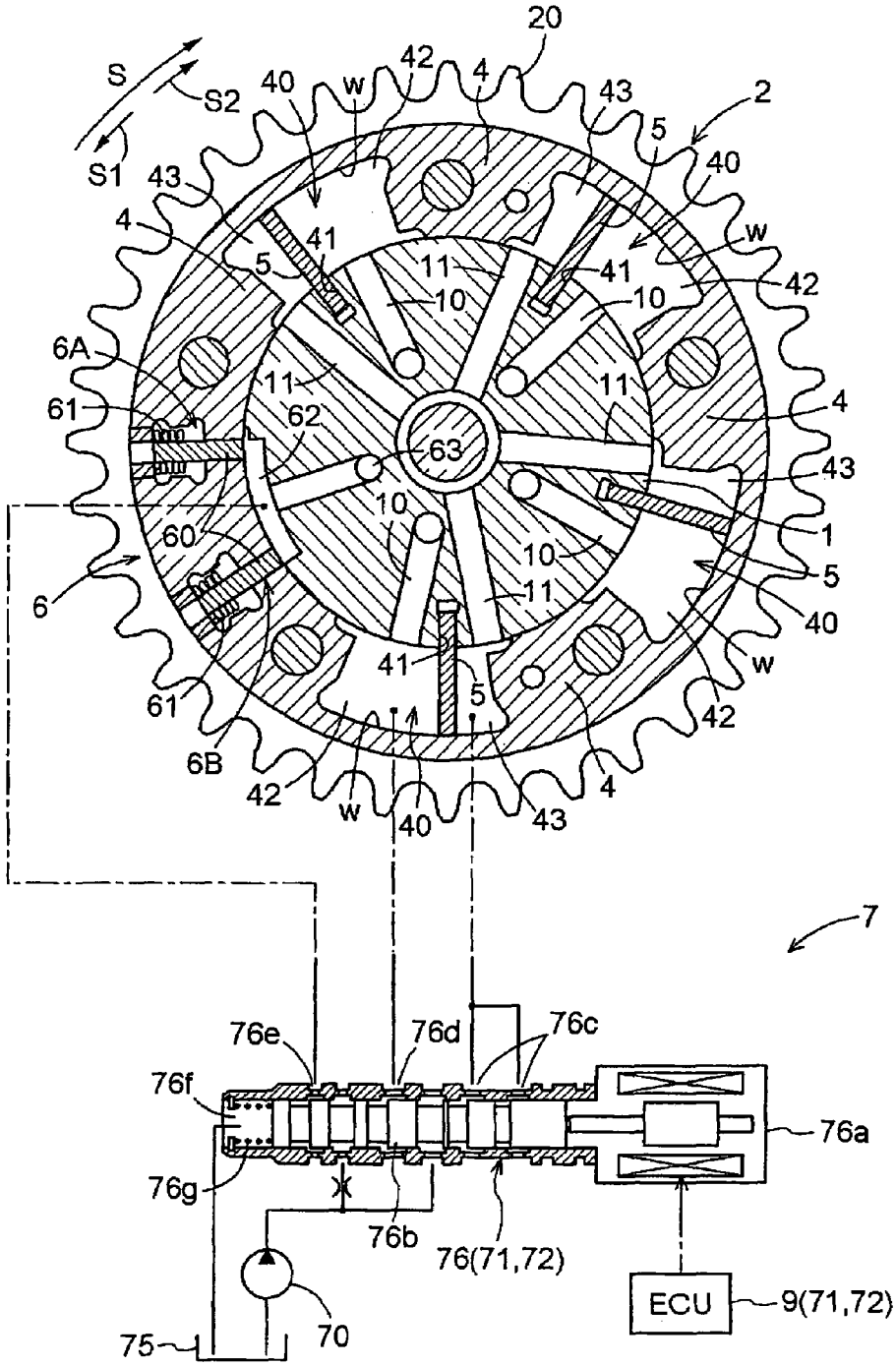
FIG. 3 is a cross-sectional view taken on line III-III showing an unlocked state of relative rotational phase by a lock mechanism.

It is assumed that hydraulic oil is constantly supplied to the lock chamber 62 of the lock mechanism 6 during control of relative rotational phase for displacing spool position of the control valve 76 from position W2 to position W6, and as shown in FIG. 3, the lock release position for allowing relative rotation between the internal rotor 1 and the external rotor 2 is maintained. In this case, hydraulic oil is supplied to the advanced angle chamber 43 and the retarded angle chamber 42 and also to the lock chamber 62 by means of the common oil pump 70. Thus, pressure of hydraulic oil supplied to the lock mechanism 6 may be temporarily reduced because a large amount of hydraulic oil needs to be supplied to the retarded angle chamber 42 or the advanced angle chamber 43 when the difference between the current phase of a relative rotational phase and target phase for the change is significant and the phase difference at one time is significant, and the hydraulic oil pressure in the lock chamber 62 may be reduced to below the value necessary to maintain the lock mechanism 6 in the lock release position. In this circumstance, the lock body 60 may be caught by the lock chamber 62 because the lock body 60 projects to the lock chamber 62 when relative rotational phase passes through the locked phase.

The control unit 9 controls the control valve 76 to restrict upper limit of the rate of change in the relative rotational phase under a predetermined condition at a state where the lock mechanism 6 is controlled to be maintained in the lock release position in order to prevent the decline of pressure of hydraulic oil in the lock chamber 62. More particularly, the control unit 9 controls to restrict upper limit of the rate of a relative rotational phase change by adjusting the spool position at position W3 or position W5 by controlling feeding amount (i.e., duty value of electric current) to the solenoid 76*a* of the control valve 76. As shown in FIG. 4, the control valve 76 is configured to adjust opening degree of the port in accordance with stroke amount of the spool 76*b* when the spool position is at position W3 or position W5, and to change the rate of a relative rotational phase change between the external rotor 2 and the internal rotor 1. That is, the control valve 76 adjusts supply amount or discharge amount of hydraulic oil relative to the pressure chamber 40 by adjusting opening degree of the port.

The control unit 9 determines upper limit of the rate of relative rotational phase change between the internal rotor 1 and the external rotor 2 within a range where pressure of hydraulic oil in the lock chamber 62 does not become below necessary pressure to maintain the lock mechanism 6 in the lock release position (i.e., hereinafter referred as lock release necessary pressure). In this case, whether pressure of hydraulic oil in the lock chamber 62 is declined below the lock release necessary pressure and value of the lock release necessary pressure are fluctuated depending on operational state of the internal combustion engine.

That is, in case that the higher the pressure of hydraulic oil at inlet side of the control valve 76 (i.e., original hydraulic pressure) is high, the pressure of hydraulic oil supplied to the lock chamber 62 is maintained highly even if hydraulic oil is supplied on a massive scale to the retarded angle chamber 42 or the advanced angle chamber 43. Thus, whether pressure of hydraulic oil in the lock chamber 62 is declined below the lock release necessary pressure by supplying hydraulic oil to either the retarded angle chamber 42 or the advanced angle chamber 43 is fluctuated in accordance with the original hydraulic pressure.

In the meantime, because the oil pump 70 is driven by means of driving force of the engine, the higher the original hydraulic pressure assumes, the higher rotational speed of the engine. On the other hand, because the higher the temperature of hydraulic oil, the greater a leak of hydraulic oil in the engine because of decline of viscosity of hydraulic oil, the original hydraulic pressure is declined. Thus, approximately constant relationship is established between the original hydraulic pressure and engine rotational speed, and between the original hydraulic pressure and temperature of hydraulic oil.

Further, according to the embodiment of the present invention, the locked condition is established by projecting the lock body 60 of the lock mechanism 6 into the lock chamber 62 provided on the internal rotor 1 from the side of the external rotor 2. Thus, when the engine rotational speed is higher, that is, when the rotational speed of the internal rotor 1 and the external rotor 2 rotated by mean of the crankshaft is higher, the centrifugal force for biasing the lock body 60 in the direction to be the lock release position is applied, and the lock mechanism 6 can be maintained in the lock release position even when the pressure of hydraulic oil in the lock chamber 62 is low or hydraulic oil in the lock chamber 62 is at draining state. Accordingly, value of lock release necessary pressure is fluctuated in accordance with the engine rotational speed.

As foregoing, whether pressure of hydraulic oil in the lock chamber 62 is declined below lock release necessary pressure is fluctuated in accordance with pressure of hydraulic oil at inlet side of the control valve 76, or the temperature of hydraulic oil and engine rotational speed. The value of lock release necessary pressure is fluctuated in accordance with the engine rotational speed. Accordingly, the control unit 9 determines value of lock release necessary pressure on the basis of information of engine rotational speed, and further determines upper limit of the rate of change in the relative rotational phase where pressure of hydraulic oil in the lock chamber 62 assumes equal to or greater than the determined lock release necessary pressure on the basis of information of temperature of hydraulic oil and engine rotational speed or pressure of hydraulic oil at inlet side of the control valve 76, and the control unit 9 controls the control valve 76 so that the rate of change in the relative rotational phase becomes equal to or less than the upper limit.

With the construction according to the embodiment of the present invention, the control unit 9 includes an upper limit rate table defining relationship between an operational state of the engine detected by the operational state detection means 100 and an upper limit for the rate of change in the relative rotational phase where pressure of hydraulic oil in the lock chamber 62 becomes equal to or greater than lock release necessary pressure. The upper limit rate table is pre-stored in a memory 92, and an upper limit for the rate of change in the relative rotational phase is determined on the basis of the upper limit rate table.

Figure 6:
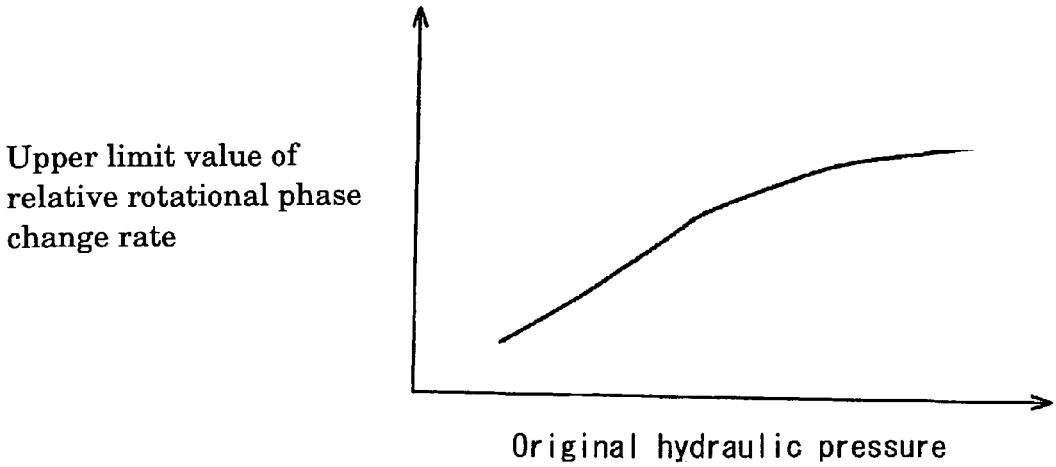
FIG. 6 is a view showing an example of a table for upper limit speed according to the embodiment of the present invention.

An example of the upper limit rate table is shown in FIG. 6. Because approximately constant relationship is established between the original hydraulic pressure and engine rotational speed, and between the original hydraulic pressure and temperature of hydraulic oil, upper limit value for the rate of change in the relative rotational phase where pressure of hydraulic oil in the lock chamber 62 becomes equal to or greater than lock release necessary pressure fluctuated in accordance with engine rotational speed can be approximately accurately shown using the relationship with the original hydraulic pressure. Thus, with the upper limit rate table according to this example, the original hydraulic pressure serves as a variable, and a table is formed by determining upper limit value of the rate of a relative rotational phase change where pressure of hydraulic oil in the lock chamber 62 fluctuated in accordance with the variable assumes equal to or greater than the lock release necessary pressure.

Figure 7:
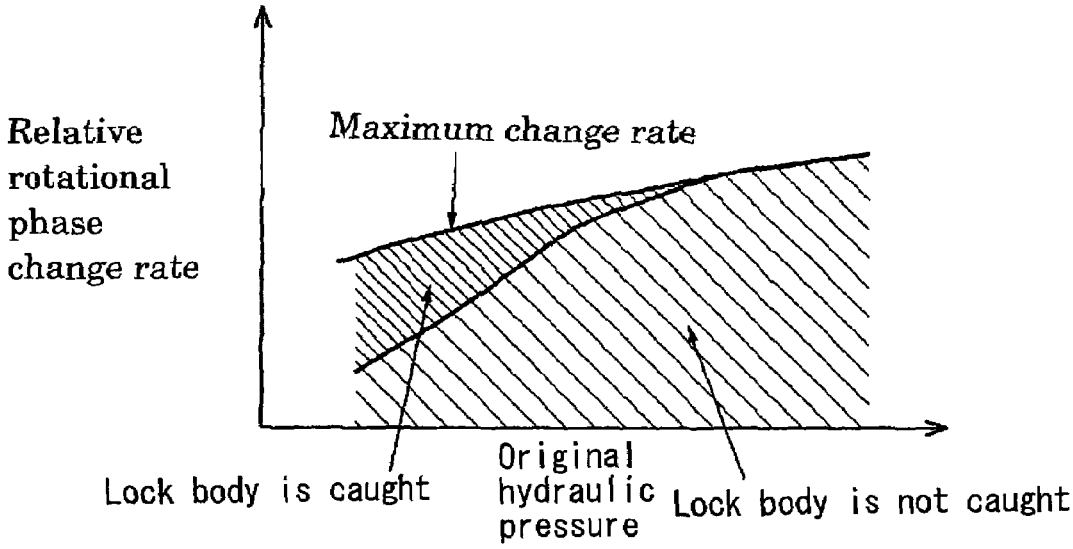
FIG. 7 is a view showing an experimental result for determining the table for upper limit speed according to the embodiment of the present invention.

The upper limit value for the rate of change in the relative a rotational phase in the upper limit rate table is determined, for example, by obtaining a formula for upper limit value of the rate of change in the relative rotational phase and the original hydraulic pressure by means of regression calculation, or the like, on the basis of experimentally obtained data. FIG. 7 shows an experimental result for examining whether pressure of hydraulic oil in the lock chamber 62 is equal to or greater than lock release necessary pressure depending on whether the lock body 60 is caught at the lock chamber 62 because of the lock body 60 of the lock mechanism 6 projecting to the lock chamber 62 when a relative rotational phase passes through the locked phase by changing relationship between the original hydraulic pressure and relative rotational phase change rate. With the upper limit rate table shown in FIG. 6, the maximum rate of change in the relative rotational phase within a range where the lock body 60 is not caught at the lock chamber 62 is determined as upper limit value for the rate of change in the relative rotational phase where pressure of hydraulic oil in the lock chamber 62 becomes equal to or greater than lock release necessary pressure on the basis of experimental result shown in FIG. 7.

The control unit 9 determines upper limit value for the rate of change in the relative rotational phase on the basis of the upper limit rate table shown in FIG. 6 and pressure of hydraulic oil at inlet side of the control valve 76 (i.e., the original hydraulic pressure) detected by the hydraulic pressure sensor 103, and controls to restrict the rate of relative rotational phase change between the internal rotor 1 and the external rotor 2 to be equal to or less than the determined upper limit value. A control by the control unit 9 is conducted by determining feeding amount (i.e., duty value of electric current) for obtaining the rate of change in the relative rotational phase equal to or less than the determined upper limit value based on the response characteristics table shown in FIG. 4 and by inputting the feeding amount to the control valve 76. In this case, because change in the relative rotational phase is completed as quickly as possible with the range where the lock body 60 is not caught at the lock mechanism 6, it is favorable for inputting feeding amount for obtaining the rate of change in the relative rotational phase corresponding to the determined upper limit value into the control valve 76.

Because approximately constant relationship is established between the original hydraulic pressure and engine rotational speed, and between the original hydraulic pressure and temperature of hydraulic oil, the original hydraulic pressure may be estimated from temperature of hydraulic oil and engine rotational speed. Thus, when the engine does not include the hydraulic pressure sensor 103 for detecting the original hydraulic pressure, the original hydraulic pressure is estimated by the temperature of hydraulic oil and engine rotational speed, and upper limit value for the rate of change in the relative rotational phase can be determined by applying the estimated original hydraulic pressure to the upper limit rate table. In this case, engine rotational speed can be detected by the rotational speed sensor 105, and temperature of hydraulic oil can be detected by the hydraulic temperature sensor 104. Because a constant relationship is established between temperature of hydraulic oil and temperature of cooling water of the engine, cooling water temperature detected by means of the water temperature sensor 106 can be used instead of temperature of hydraulic oil.

Although an example that the upper limit rate table includes fluctuation of lock release necessary pressure by the centrifugal force accompanying the engine rotation by defining the upper limit rate table having original hydraulic pressure as a variable because approximately constant relationship is established between the original hydraulic pressure and engine rotational speed, and between the original hydraulic pressure and temperature of hydraulic oil according to the embodiment explained above, it may be difficult to accurately define fluctuation of lock release necessary pressure by the centrifugal force accompanying engine rotation using relationship with the original hydraulic pressure depending on construction of the variable valve timing control device. In this case, it is favorable to define engine rotational speed as a variable and to store lock release necessary pressure fluctuated in accordance with the variables in the memory 92 as a lock release necessary pressure table. In this case, the control unit 9 is configured to determine upper limit value for the rate of change in the relative rotational phase displacement speed on the basis of pressure of hydraulic oil at inlet side of the control valve 76 detected by the hydraulic pressure sensor 103 (i.e., the original hydraulic pressure), engine rotational speed detected by the rotational speed sensor105, the upper limit rate table, and the lock release necessary pressure table.

Although feeding amount to the solenoid 76*a* of the control valve 76 by the control unit 9 is controlled by changing duty value (%) of the electric current supplied to the solenoid 76e with the construction of the foregoing embodiment of the present invention, instead, feeding amount to the solenoid 76*a* can be controlled by changing electric current value, by changing duty value (%) of electric voltage, or electric voltage value, or the like.

Although restriction of upper limit of displacement speed of relative rotational phase by the control unit 9 is controlled by determining feeding amount for obtaining relative rotational phase displacement speed equal to or less than a predetermined upper limit value on the basis of response characteristics table shown in FIG. 4, and by inputting the feeding amount in the control valve 76, control for restricting upper limit of displacement speed of relative rotational phase can be conducted without using a response characteristics table. In that case, for example, the control unit 9 calculates a relative rotational phase between the camshaft and the crankshaft, that is, the current value of a relative rotational phase between the internal rotor 1 and the external rotor 2 from a phase of the camshaft detected by the cam angle sensor 101 and a phase of the crankshaft detected by the crank angle sensor 102. The control unit 9 controls spool position of the control valve 76 by inputting control variable (e.g., electric current value, electric voltage value, or duty values of the electric current or electric voltage value) in accordance with target phase difference defined as a difference between the target value of a relative rotational phase determined in accordance with an operational state of the engine and the current value, into the solenoid 76*a* of the control valve 76, and controls the rate of a relative rotational phase change. Further, the control unit 9 conducts feedback operation control of the control valve 76 in order to make the current value of the relative rotational phase equal to the target value.

The control unit 9 controls to restrict upper limit of the rate of a relative rotational phase change by restricting upper limit of the target phase difference. That is, in this case, because the control unit 9 controls the rate of a relative rotational phase change by inputting control variable in accordance with target phase difference to the control valve 76, the rate of a relative rotational phase change increases when target phase difference is increased in case there is no restriction control. In this case, in order to prevent that pressure of hydraulic oil supplied to the lock mechanism 6 is temporarily declines by supplying hydraulic oil on a massive scale to either the retarded angle chamber 42 or the advanced angle chamber 43 and to prevent that pressure of hydraulic oil in the lock chamber 62 is declined below lock release necessary pressure, upper limit of the rate of a relative rotational phase change is restricted by limiting the target phase difference at value smaller than original value. Because target value of a relative rotational phase is not changed even in the foregoing case, the control unit 9 controls change of a relative rational phase further until the current value of a relative rotational phase conforms to the target value after the completion of change of target phase difference. Accordingly, relative rotational phase can be displaced to the target value when restricting upper limit of the change speed of relative rotational phase.

According to the embodiment of the present invention, because supply of hydraulic fluid on a massive scale in short time relative to the fluid pressure chamber is restricted by restricting the rate of change in the relative rotational phase at an upper limit, decline of pressure of the hydraulic fluid supplied to the lock release pressure chamber can be prevented when the relative rotational phase is changed simultaneously with supplying the hydraulic fluid to the lock release pressure chamber by the lock control device.

According to the embodiment of the present invention, that the lock body is caught at the lock chamber when changing the relative rotational phase can be prevented because the phase control device restricts upper limit of the rate of the relative rotational phase change so that a pressure of hydraulic fluid in the lock release pressure chamber is greater than or equal to a pressure necessary to maintain the lock mechanism in the lock release position based on a detection result by the operational state detection means.

According to the embodiment of the present invention, because the rate of change in the relative rotational phase can be accurately controlled by controlling the fluid control mechanism based on the response characteristics of the rate of change in the relative rotational phase relative to control variable inputted to the fluid control mechanism, upper limit of displacement of the relative rotational phase can be further accurately restricted, and the time it takes for the relative rotational phase change can be shortened, which helps prevent the lock body from being caught in the lock chamber when the relative rotational phase is changed.

The invention claimed is:

1. A variable valve timing control device comprising:

a driving side rotational member (2) synchronously rotating with a crankshaft;

a driven side rotational member (1) positioned coaxially with the driving side rotational member, and synchronously rotating with a camshaft;

a fluid pressure chamber (40), formed in at least one of the driving side rotational member and the driven side rotational member, for generating a biasing force for changing a relative rotational phase between the driving side rotational member and the driven side rotational member by hydraulic fluid supplied into or discharged from the fluid pressure chamber;

a lock mechanism (6) movable between a lock position for preventing a relative rotation between the driving side rotational member and the driven side rotational member and a lock release position for allowing the relative rotation;

a lock release pressure chamber (62) for generating a biasing force to move the lock mechanism (6) to the lock release position by supply of the hydraulic fluid;

a phase control device (71) for controlling a rate of the relative rotational phase change by controlling supply or discharge of hydraulic fluid into or out of the fluid pressure chamber; and a lock control device (72) for controlling supply or discharge of hydraulic fluid into or out of the lock release pressure chamber; and an operational state detection means (100) for detecting operational state of an internal combustion engine, wherein when the lock control device supplies hydraulic fluid to the lock release pressure chamber, the phase control device restricts upper limit of the rate of the relative rotational phase change so that a pressure of hydraulic fluid in the lock release pressure chamber is greater than or equal to a pressure necessary to maintain the lock mechanism in the lock release position based on a detection result by the operational state detection means.

2. The variable valve control device according to claim 1, wherein the operational state detection means includes at least one of a hydraulic fluid pressure detection means (103) for detecting a pressure of the hydraulic fluid, an hydraulic fluid temperature detection means (104) for detecting temperature of the hydraulic fluid, a cooling water temperature detection means (106) for detecting cooling water temperature of the internal combustion engine, and a rotational speed detection means (105) for detecting rotational speed of either the crankshaft or a portion driven by the crankshaft.

3. The variable valve control device according to claim 1 or 2, wherein the phase control device includes a fluid control mechanism (76) for controlling supply or discharge of hydraulic fluid and a control means (9) for controlling operation of the fluid control mechanism by inputting a predetermined control variable to the fluid control mechanism; and wherein the control means determines control variable input to the fluid control mechanism based on response characteristics of the rate of the relative rotational phase change with respect to the control variable inputted to the fluid control mechanism.

4. The variable valve control device according to claim 1 or 2, further comprising:

a phase detection means (101, 102) for detecting current phase of the relative rotational phase; wherein the phase control device includes a fluid control mechanism (76) for controlling supply or discharge of the hydraulic fluid, and a control means (9) for controlling operation of the fluid control mechanism by inputting control variable, that is a function of a target phase difference defined as a difference between a target phase for the relative rotational phase and the current phase, into the fluid control mechanism, and for controlling operation of the fluid control mechanism so that the current phase of the relative rotational phase becomes equal to the target phase; wherein the control means restricts upper limit of the rate of the relative rotational phase change by restricting upper limit of the target phase difference.

5. The variable valve control device according to claim 1, wherein the phase control device includes a control valve (76) in communication with the fluid pressure chamber, the control valve for controlling supply amount or discharge amount of hydraulic fluid to or from the fluid pressure chamber, a control means (9) for controlling operation of the control valve by inputting control variable corresponding to the supply amount or the discharge amount of the hydraulic fluid to or from the control valve, and a change rate upper limit setting means (91, 92) for setting upper limit of the rate of the relative rotational phase based on an operational state of the internal combustion engine detected by the operational state detection means; and wherein the control means is configured to input to the control valve the control variable corresponding to the supply amount or the discharge amount of the hydraulic fluid so as to maintain the rate of the relative rotational phase change less than or equal to the upper limit value.

6. The variable valve control device according to claim 5, wherein a displacement speed upper limit setting means includes a memory means (92) for storing a relationship between an operational state of the internal combustion engine and an upper limit of rate of the relative rotational phase change.

7. The variable valve control device according to claim 6, wherein the relationship between the operational state of the internal combustion engine and the rate of the relative rotational phase change corresponds to a relationship between a pressure of hydraulic fluid at an inlet side of the control valve and a rate of the relative rotational phase change.

* * * * *